United States Patent [19]

Ling

[11] 4,327,566

[45] May 4, 1982

[54] LATCHING DEVICE AND COMBINATION LOCKING MEANS

[76] Inventor: Chong-Kuan Ling, Apt. 10-1, No. 9 La. 464, Tung-Hwa S. Rd., Taipei, Taiwan

[21] Appl. No.: 113,961

[22] Filed: Jan. 21, 1980

[51] Int. Cl.[3] ..... E05B 37/02

[52] U.S. Cl. ..... 70/312

[58] Field of Search ..... 70/66, 67, 68, 69–76, 70/312, 3–5

[56] References Cited

U.S. PATENT DOCUMENTS

| | | | |
|---|---|---|---|
| 1,672,425 | 6/1928 | Rouanet | 70/312 |
| 2,189,342 | 2/1940 | Eber | 70/312 |
| 2,267,374 | 12/1941 | Eber | 70/312 |
| 3,416,338 | 12/1968 | Gehrie | 70/312 |
| 3,961,505 | 6/1976 | Gehrie | 70/66 |
| 4,123,923 | 11/1978 | Bako | 70/74 |

FOREIGN PATENT DOCUMENTS

| | | | |
|---|---|---|---|
| 2659186 | 7/1978 | Fed. Rep. of Germany | 70/312 |
| 2032991 | 5/1980 | United Kingdom | 70/312 |

*Primary Examiner*—Robert L. Wolfe

*Attorney, Agent, or Firm*—Shoemaker and Mattare, Ltd.

[57] ABSTRACT

A combination lock of improved construction wherein the combination locking means employs key and slot engagements between the sleeves and the shaft, the sleeves being capable of selectively engaging with or disengaging from the dials mounted thereon. The lock also employs a latching piece mounted on one end of the shaft and resiliently moveable along the shaft at any combination with an operating lever mounted on the other end of the shaft to open the lock when moved in one direction and to release the engagement between the dials and sleeves for selecting the opening combination when moved in the opposite direction. The lock of this invention permits the insertion of the eye piece of the hasp member into the lock body without the need of keeping the lock in an opening combination, and also allows the selection of an opening combination by moving the lever for opening the lock toward the opposite direction with the eye piece of the hasp member apart from the lock body.

3 Claims, 8 Drawing Figures

LATCHING DEVICE AND COMBINATION LOCKING MEANS

BRIEF DESCRIPTION OF THE INVENTION

This invention relates to combination locks for luggage cases or the like, and more particularly relates to improvements in devices of the type disclosed in U.S. Pat. No. 3,416,336 granted Dec. 17, 1968.

The lock of the aforesaid patent is provided with a latching slide member having a nose portion at one end to latch the hasp device and a plurality of slots, each having a width through which the dial and the flange of the sleeve may be extended.

The latching slide member is kept in locking position by extending the flanges of the sleeves through the slots, and is releasable only when the flat portions of the sleeves are aligned as in an opening combination to clear the adjacent portions of the latching slide member. The lock of the aforesaid patent is also provided with a lever on the backside of the lock for disengaging the sleeves from the dials to enable the selection of a new opening combination.

A lock of such construction may suffer from such shortcomings as making sure that the dials are at the opening combination before putting the hasp member into latched position, otherwise the lock will not receive the eye piece of the hasp member or will even be subject to damage if forced inadvertently. It is also inconvenient to operate the lever on the backside while the selection of an opening combination is done on the front side.

This invention offers improvements to aforesaid shortcomings with a novel latching piece mounted on one end of the shaft on which the combination dials with sleeves are mounted, the latching piece being resiliently movable along the shaft with no restriction by the combination when the eye piece of the hasp member is inserted, and a lever mounted on the other end of the shaft to be operated from the front side to open the lock when moved in one direction and to release the engagement between the dials and the sleeves to enable the selection of a new opening combination when moved in the opposite direction.

The main object of this invention is to provide an improved latching device associated with a combination locking means and resiliently movable from the locking position to enable the insertion of the eye portion of the hasp member into the lock body without the need of keeping the lock in an opening combination.

Another object of this invention is to provide an improved combination locking means in which the selection of an opening combination may be performed on the frontside of the lock body with the same operating means for opening the lock.

The aforesaid objects and the features of the improvements of this invention will be more readily understood from the following detailed description, taken in conjunction with the accompanying drawings illustrating a preferred embodiment of the invention, in which.

DETAILED DESCRIPTION OF THE INVENTION

Figure 1:
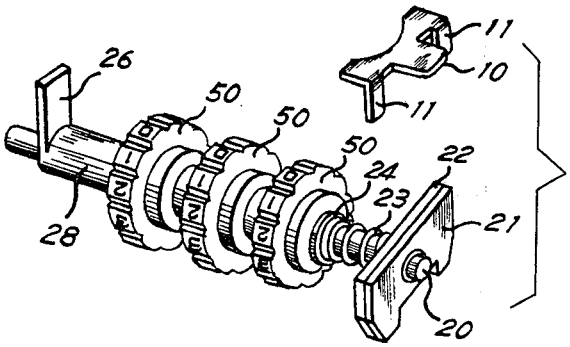
FIG. 1 is a partially exploded, oblique view of the combination locking assembly of the embodiment of this invention, with the latching piece removed from the combination locking assembly.

Referring to the drawings, the combination lock of this invention primarily comprises a combination locking assembly (FIG. 1), a face plate 12 and a casing 25. The combination locking assembly further comprises a shaft 20, a plurality of dials 50, each dial having one sleeve 40, a latching piece 11 inserted between the movable plate 22 and the fixed plate 21, the movable plate 22 being slidably mounted on the shaft and urged by the spring 23 toward the fixed plate 21 which is fixed to one end portion of the shaft 20, a plate 20*a* and a collar 28 slidably mounted on the other end portion of the shaft 20. The dials 50 are each formed with ten slots 51 equally distributed along the circumference of the bore thereof, and also provided with ten numerals of 0 to 9 in equally spaced relation on the outer circumference. Between adjacent numerals are notches 52 formed to received the fingers 71 formed on the spring plate 70 to frictionally restrict the rotation of the dials meantime to allow the dials to rotate in only one direction, as in the conventional construction. The sleeves 40 are each provided with a flange 42, a pair of keys 41 disposed 180 degrees apart from each other on the outer surface of the shank abutting the side surface of the flange, a slot 44 formed longitudinally on the wall of the bore, and an annular groove 43 on the inner part of the flange 42. The dials 50 are each slidably mounted on the shank portion of a sleeve 40 respectively, with the pair of keys 41 slidably engaged with corresponding slots 51 on the dial 50. The sleeves 40 having respective dials 50 mounted thereon are slidably mounted on the shaft 20 with their flanges directed toward the end of the shaft where the latching piece is mounted, with the keys 27 fixedly provided on the shaft each slidably fit into the slots 44 of the sleeves 40 respectively. The sleeves 40 are each of equal and proper length so that a proper distance is maintained in between each of the two neighboring dials 50 when the sleeves are mounted with their ends of the shanks abutting the end surface of the flanges. The keys 27 are disposed in the spacing corresponding to the length of a sleeve so that when one of them is aligned to fit into the annular groove 43 of a sleeve 40 the remaining keys 27 are also aligned to fit into the annular grooves 43 of the remaining sleeves 40 respectively. In this arrangement the sleeves 40 are allowed to slide along the shaft 20 when the keys 27 are aligned to fit into the slots 44, and are allowed to rotate when the keys 27 are aligned to fit into the annular grooves 43. The keys 27 are disposed in the same straight line along the axis of the shaft with their angular position in respect to the stationary part fixed since the rotational movement of the shaft 20 is prevented by the fixed plate 21 carrying the latching piece 10 to abut on the back side of the face plate 12.

Figure 2:
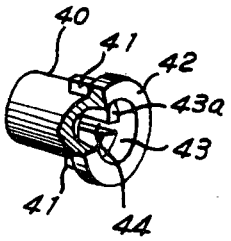
FIG. 2 is an enlarged, oblique view, with a portion cut away, of the sleeve member.

As shown in FIG. 1 and FIG. 2 the spring 23 is mounted on the shaft in between the movable plate 22 and the retaining plate 24 which is also slidably mounted on the shaft abutting on the end surface of the first sleeve 40 (counting from right to left). The movable plate 22 is axially retained by the fixed plate 21 which is securely fixed on the end of the shaft 20. The collar 28 having a lever or extention means 26 for connecting the knob 60 thereto is slidably mounted on the other end of the shaft. In between the collar 28 and the last sleeve there is a plate 21*a* slidably mounted on the shaft. A stop means 29 is provided on the end of the shaft 20 over the end of the collar 28 in order to retain the collar 28 thereon. The plate 21*a* has its upper and lower edge slidably abutting on the back side of the face plate 12 and the inner side of the casing 25 respectively so that the shaft 20 is supported with respect to the casing 25 and the face plate 12. With the fixed plate 21 securely mounted on one end and with the collar 28 stopped by the stop pin 29 on the other end of the shaft and with compression spring 23 mounted in between the movable plate 22 and the retaining plate 24, the sleeves 40 are resiliently held in position on the shaft 20.

The face plate 12 is of rectangular shape, having a plurality of longitudinally spaced slots 14, the number of the slots being the same as that of the dials 50, (which is three in the preferred embodiment,) each slot 14 being of width slightly greater than the thickness of a dial 50, and of a length such as to allow partial protrusion of the dials therethrough.

Figure 3:
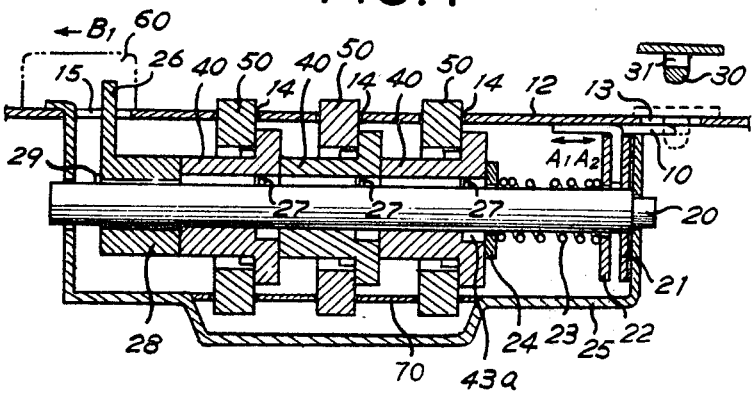
FIG. 3 is a cross-sectional, top view of the complete assembly of the embodiment of this invention, in the locking state.
Figure 6:
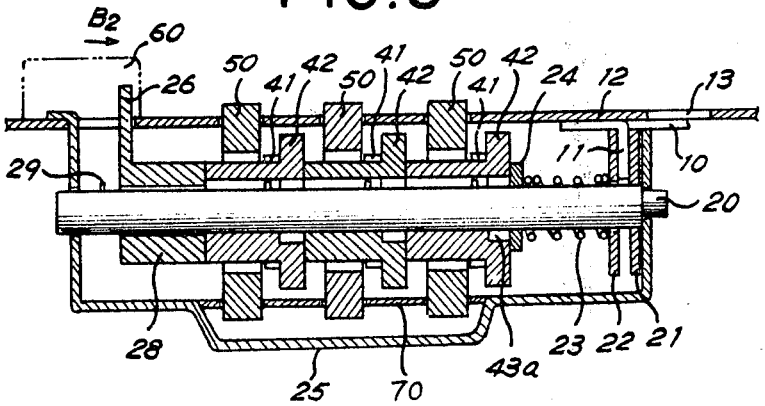
FIG. 6 is a view similar to FIG. 3 except that the lever is moved toward the opposite end of the shaft and the sleeves are disengaged from the dials to enable the selection of opening combination.

The face plate 12 is also provided with a slot 13, as shown in FIG. 3 and FIG. 6 through which the eye piece on the tongue of the hasp assembly, may be extended. The face plate 12 is further provided with an opening 15 through which the lever 26 of the collar 28 may be extended. Mounting holes, not shown, are provided at each corner of the face plate 12 so that the mounting means such as rivets may be inserted there.

The latching piece 10 as shown in FIG. 1 is provided with lug portions 11 perpendicular to the latching piece, the lug portions 11 being inserted in between the movable plate 22 and the fixed plate 21 with the latching piece flush with the top edges of the plates 22 and 21. The latching piece 10 is so arranged as its top, flat surface abuts on the back side of the face plate 12 and is slidable thereon in the direction of A1-A2, as shown in FIG. 3, with the nose portion of the latching piece 10 extending through a slot provided on the side plate of the casing 25. The tip of the nose portion of the latching piece 10 will reach substantially to the center portion of the slot 13 when it is in locking position.

Figure 4:
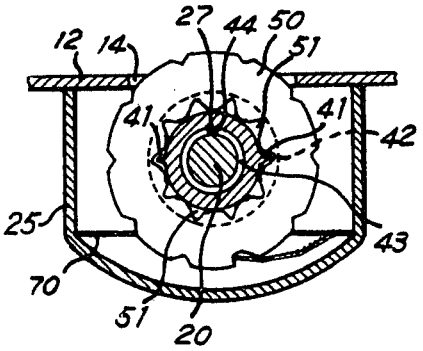
FIG. 4 is an enlarged, transverse, cross-sectional view of the assembly, showing the relations of the shaft, sleeves and dials in an opening combination.
Figure 5:
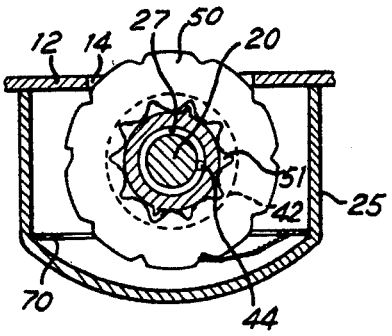
FIG. 5 is a view similar to FIG. 4 except that the assembly is in locking combination.

The casing 25 is substantially of a box shape with one side open; the face plate is mounted on the casing 25 as to cover the open side thereof. The combination locking assembly as described previously is placed in the casing and supported by the fixed plate 21 at one end and the movable plate 21*a* in between the collar 28 and the last sleeve 40, as shown in FIGS. 3 and 6. The axial movement of the dials 50 slidably mounted on the sleeves 40 is restricted by the slots 14 since the dials 50 partially extend through the slots 14 which are of a width only slightly greater than the thickness of a dial. The casing 25 is also provided with a spring plate 70 which is formed with slots, not shown, through which the dials 50 may be partially extended, and fingers 71 resiliently pressing the dials 50 radially to produce certain rotational friction on the dials 50 with the tips of the fingers falling in the notches 52 formed on the circumference of the dials 50 as shown in FIGS. 4 and 5, so that the angular position of the dials are firictionally maintained, meantime the fingers act in association with the notches 52 as a ratchet and allow the rotation of the dials only in one direction.

The locking and unlocking operation will now be described. Being urged by the compression spring 23, the sleeves 40 are normally in complete engagement with the dials and the annular grooves 43 are aligned to receive the keys 27. In this arrangement the sleeves 40 in complete engagement with the dials are free to rotate around the shaft 20, but are unable to slide along the shaft 20 as the movement will be blocked by the side walls 43*a* in the annular grooves 43 and the keys 27 unless the slots 44 on the sleeves are aligned to receive the keys 27 as on the opening combination. Since the axial movement of the dials is restricted by the face plate 12 and the slots of the spring plate 70 the axial movement of the shaft 20 in the direction of arrow B1 is prevented, therefore, the latching piece can not be moved by the lever 26 with the shaft 20, and the lock is "locked".

To "unlock" the lock, rotate the dials 50 till the opening combination is aligned, then the slots 44 on the sleeves are aligned in the same straight line with that of the keys 27 and thus the shaft is free to move axially in the direction of the arrow B1. By moving the lever 26 in the direction of the arrow B1, the shaft 20 is moved accordingly while the sleeves with the dials are kept still by the face plate 12 and the spring plate 70; the spring 23 is compressed and the latching piece is moved in the direction of arrow A1 and thereby the lock is "unlocked". By releasing the lever 26 the shaft 20 will return to its original position because of the resilient force of spring 23 and so will the latching piece 10.

As previously introduced, one of the major features of this invention is that the eye piece 30 of the hasp assembly can be inserted into the lock body to be "latched" by the latching device at any combination. Its function and operation will now be described.

Referring to FIG. 3, the latching piece 10 is supported by movable plate 22 and fixed plate 21 with its upper surface abutting on the back side of the face plate 12, and is urged by the spring 23 against the side plate of the casing 25. As the tip portion of the latching piece 10 is provided with a tapered edge to facilitate the insertion of the eye piece 30 of the hasp member into the slot 13, the latching piece 10 being guided by the face plate 12 and the shaft 20 is displaced in the direction of the arrow A1 when the eye piece 30 of the hasp member is inserted in the opening 13. Since the movable plate 22 is movable along the shaft 20 in the direction of arrow A1, the plate 22 will be pushed by the lug portions 11 of the latching piece 10 to compress the spring 23 allowing the latching piece 10 to be displaced by the eye piece 30 of the hasp member. As soon as the eye piece 30 of the hasp member is fully inserted to clear the tip portion of the latching piece 10, the tip portion of the latching piece 10 is pushed by the resilient force of the spring 23 into the eye portion 31 to "latch" the eye of the hasp member. This process can be performed without the need of keeping the combination locking assembly in the opening combination.

The selection or changing of an opening combination can be performed as follows, When the combination locking assembly is in the original opening combination with the slots 44 of the sleeves 40 thus aligned with that of the keys 27, push the lever 26 in the direction of the arrow B2 as shown in FIG. 6. Since the sleeves are urged by the spring 23 and the axial movement of the shaft 20 in the direction of the arrow B2 is prevented by the plate 21 and the side wall of the casing 25, the spring 23 is compressed and the sleeves are moved along the shaft and disengaged from the dials 50 when the lever 26 is pushed in the direction of the arrow B2. With the lever 26 pushed in the direction as described and held in that position, rotate the dials 50 to obtain the desired combination, and then release the lever 26 to let the sleeves 40 return to engage with the dials 50, and the selection or change of opening combination is thereby completed.

The hasp assembly, not shown may be of any known construction with the nose portion 30 of the eye of the hasp member as disclosed in the foregoing description.

Figure 7:
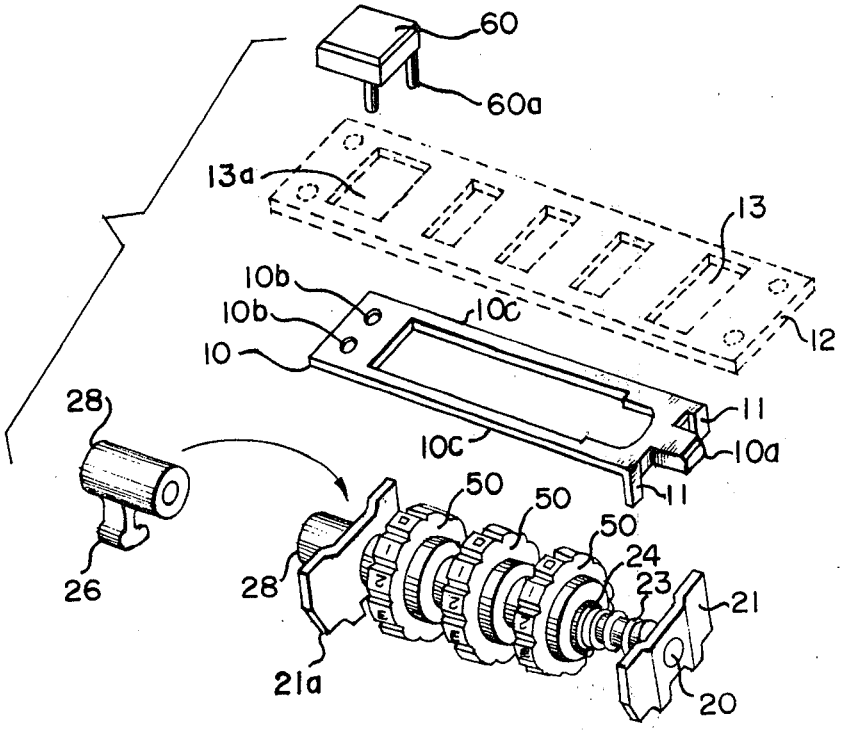
FIG. 7 is a partially exploded oblique view of the combination locking assembly with slight modifications in the latching piece and the operating lever.
Figure 8:
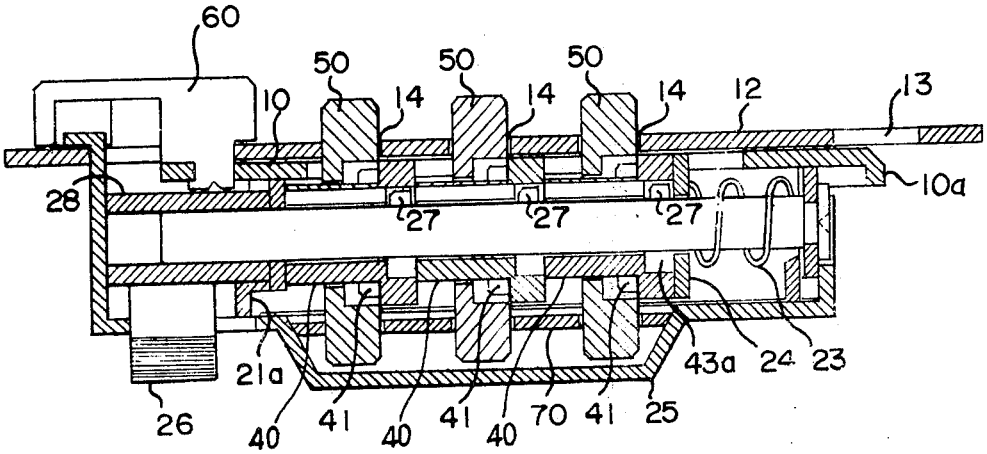
FIG. 8 is a cross-sectional, top view of the complete assembly of a modified embodiment of this invention, showing an application of the combination locking means according to this invention.

The combination locking means of this invention as described hereinbefore can be employed in conventional combination locks with slight modifications in the latching piece and the lever for disengaging the sleeves from the dials for selection of new combination. FIGS. 7 and 8 show an application of the combination locking means of this invention to a conventional combination lock.

As shown in FIG. 7, the latching piece 10 comprises primarily a rectangular frame provided with a nose portion 10*a* extending at one end and a pair of lug portions 11, said lug portions 11 being formed perpendicular to the latching piece per se and extending downwardly, and two apertures 10*b* at the other end through which the rivet means 60*a* of the operating knob 60 can be inserted and staked. The latching piece is connected to the knob 60 with the rivet means 60*a* extending through an opening 13*a* formed on the face plate, and is freely slidable along the backside of the face plate with the knob 60 for a distance of the width of the opening 13*a*. When assembled with the other parts of the combination locking assembly, the latching piece 10 rides on the fixed plate 21 which is fixed on one end of the shaft 20 and the movable plate 21*a* which is slidably mounted on the shaft 20 between the last sleeve 40 and the collar 28 with the lug portions 11 attaching to the outer side of the fixed plate 21, meantime the side members 10*c* of the latching piece 10 clear the dials 50 and sleeves 40.

In this arrangement the movable plate 22 is not required and can be eliminated and thus the eye piece of the hasp member can not be inserted in the lock body unless the lock is kept at the opening combination. The lever 26 of the collar 28 extends through an opening formed on the casing 25 as in the conventional construction.

It will be apparent from the above description that the improved latching device and combination locking means of this invention renders simpler construction and more advantages and conveniences. It is also to be noted that as this invention is intended to be an improved construction of combination lock the spirit and scope of the invention are to be defined by the following claims.

What I claim is:

1. In a combination lock comprising a face plate member having longitudinally spaced slots, dials positioned in said slots, a shaft, a sleeve for each dial mounted on the shaft, a spring means urging said sleeve in engagement with said dials, a spring plate, and a casing, the improvements comprising a latching piece provided with lug means inserted in between a movable plate slidably mounted on the shaft and a fixed plate securely fixed on the shaft, said movable plate being urged by the spring means against said fixed plate, the upper surface of said latching piece abutting on the back side of the face plate and being movable therealong when displaced by the eye piece of the hasp member at any combination.

2. In a combination lock comprising a face plate member having longitudinally spaced slots, dials positioned in said slots, a shaft, a sleeve for each dial mounted on the shaft, a spring means urging said sleeve in engagement with said dials, a latching means, a spring plate, and a casing, the improvements comprising the sleeves each being formed with a slot on the bore along its axis, a flange at one end thereof, an annular groove along the inner circumference of said flange, and the shaft being provided with key means one for each sleeve aligned along the axis of the shaft, said key means being each slidably receivable by said slot and said annular groove of each sleeve respectively; the opening combination is formed when said slots of the sleeves are aligned with said key means on the shaft, and the lock is "locked" when any one of said slots is not aligned with said key means on the shaft and under this situation annular grooves are in position to receive said key means and the sleeves are free to rotate around the shaft.

3. An improved construction of a combination lock as defined in claim 2 further including a collar member slidably mounted on the shaft, said shaft being provided with a movable plate, a fixed plate and a latching piece, said collar member being provided with a knob member and a lever member firmly connected to the knob member, said shaft being further provided with a stop means which blocks the sliding movement of said collar member toward one direction so that the shaft moves with the collar when said lever member is pushed in the same direction to "unlock" the lock, the shaft remaining stationary to enable the disengagement of the sleeves from the combination dials for selection of an opening combination when said lever is pushed in the opposite direction to move said collar along the shaft following that opposite direction.

* * * * *